US009834226B2

(12) United States Patent
Izumi

(10) Patent No.: US 9,834,226 B2
(45) Date of Patent: Dec. 5, 2017

(54) TRAVELLING VEHICLE SYSTEM AND TRAVELLING METHOD FOR TRAVELLING VEHICLE

(71) Applicant: Murata Machinery, Ltd., Kyoto-shi, Kyoto (JP)

(72) Inventor: Takanori Izumi, Inuyama (JP)

(73) Assignee: MURATA MACHINERY, LTD., Kyoto (JP)

( * ) Notice: Subject to any disclaimer, the term of this patent is extended or adjusted under 35 U.S.C. 154(b) by 104 days.

(21) Appl. No.: 15/073,362

(22) Filed: Mar. 17, 2016

(65) Prior Publication Data

US 2016/0288808 A1 Oct. 6, 2016

(30) Foreign Application Priority Data

Mar. 31, 2015 (JP) ..... 2015-071781

(51) Int. Cl.
*B61B 3/00* (2006.01)

(52) U.S. Cl.
CPC ..... *B61B 3/00* (2013.01)

(58) Field of Classification Search
CPC .. B61B 3/00; B61B 3/02; B61B 13/06; B61B 10/00
USPC ..... 104/130.01, 130.07
See application file for complete search history.

(56) References Cited

U.S. PATENT DOCUMENTS

2005/0139441 A1* 6/2005 Nakao ..... B60L 5/005 191/22 R
2006/0016363 A1* 1/2006 Nakao ..... G05D 1/0229 104/88.01
2006/0222479 A1* 10/2006 Shiwaku ..... B65G 1/0457 414/267
2007/0000405 A1* 1/2007 Nakao ..... E01B 25/12 104/130.07
2016/0288808 A1* 10/2016 Izumi ..... B61B 3/00

FOREIGN PATENT DOCUMENTS

| | | |
|---|---|---|
| JP | 2-16438 | 4/1990 |
| JP | 03-248716 A | 11/1991 |
| JP | 06-017575 A | 1/1994 |
| JP | 06-087125 U | 12/1994 |
| JP | 2000-059921 A | 2/2000 |
| JP | 2000-295719 A | 10/2000 |

(Continued)

*Primary Examiner* — Jason C Smith
(74) *Attorney, Agent, or Firm* — DLA Piper LLP (US)

(57) ABSTRACT

A suspension-type travelling vehicle that travels through a gap in an intersection where tracks cross includes intersection rollers attached in front and rear of a travelling wheel along a travelling direction, and in positions different from a position of the travelling wheel along a direction orthogonal to the travelling direction within a horizontal plane. Inter-axial distances between the intersection rollers and the travelling wheel within the horizontal plane are both longer than a width of a gap along the travelling direction. The rail or the travelling vehicle is constructed such that the intersection rollers are supported by the rail in the intersection, and retreat from the rail in places other than the intersection. During passage of the travelling wheel through the gap, the weight of the travelling vehicle is supported by the intersection rollers by making both the front and rear intersection rollers contact the rail.

6 Claims, 10 Drawing Sheets

(56) References Cited

FOREIGN PATENT DOCUMENTS

| | | | |
|---|---|---|---|
| JP | 2003-029837 | A | 1/2003 |
| JP | 2007-038732 | A | 2/2007 |
| JP | 2009-248133 | A | 10/2009 |
| JP | 2012-116648 | A | 6/2012 |
| JP | 2012-162096 | A | 8/2012 |

* cited by examiner

TRAVELLING VEHICLE SYSTEM AND TRAVELLING METHOD FOR TRAVELLING VEHICLE

CROSS-REFERENCE TO RELATED APPLICATIONS

The present invention claims the benefit of priority under 35 USC 119 of Japanese application no. 2015-071781, filed on Mar. 31, 2015, which is incorporated herein by reference.

BACKGROUND OF THE INVENTION

1. Field of the Invention

The present invention relates to a travelling vehicle system and a travelling method for a travelling vehicle.

2. Description of the Related Art

It is known that in a suspension-type travelling vehicle system such as an overhead travelling vehicle system, a branching/merging part is provided on a track to make a track of travelling vehicle branch off or merge (e.g., JP 2012-162096 A). In the suspension-type travelling vehicle system, a shaft of the travelling vehicle is hung from the track, and it is thus difficult to make tracks intersect.

Accordingly, instead of making the tracks intersect, one track has been divided to form a plurality of branching/merging parts and connect the divided tracks. In this manner, however, it is necessary for the travelling vehicle to travel over a plurality of branching/merging parts so as to move between the divided tracks, and this makes the travelling time long and a track installation area large.

BRIEF SUMMARY OF THE INVENTION

It is an object of the present invention to provide a suspension-type travelling vehicle system including an intersection where a vehicle smoothly travels, and provide a travelling method.

The present invention is a system for allowing a suspension-type travelling vehicle to travel along a rail provided on a track. The system includes an intersection in which tracks cross each other, and a gap in which a rail for supporting a weight of the travelling vehicle is interrupted in the intersection. The travelling vehicle includes a travelling wheel that makes the rail support the weight of the travelling vehicle, and intersection rollers that are attached both in front and rear of the travelling wheel along a travelling direction in positions different from a position of the travelling wheel along a direction orthogonal to the travelling direction within a horizontal plane, and inter-axial distances between the intersection rollers and the travelling wheel within the horizontal plane are both longer than a width of the gap along the travelling direction. The rail or the travelling vehicle is configured such that the intersection rollers are supported by the rail in the intersection, and are separated from the rail in places other than the intersection.

Further, the present invention is a method for allowing a suspension-type travelling vehicle to travel through a gap in an intersection where tracks cross. The travelling vehicle includes a travelling wheel that makes the rail support a weight of the travelling vehicle, and intersection rollers that are attached both in front and rear of the travelling wheel along a travelling direction in positions different from a position of the travelling wheel along a direction orthogonal to the travelling direction within a horizontal plane, and inter-axial distances between the intersection rollers and the travelling wheel within the horizontal plane are both longer than a width of the gap along the travelling direction. The rail or the travelling vehicle is configured such that the intersection rollers are supported by the rail in the intersection, and are separated from the rail in places other than the intersection. During passage of the travelling wheel through the gap, the weight of the travelling vehicle is supported by the front and rear intersection rollers by making both the front and rear intersection rollers in contact with the rail.

In the present invention, since the inter-axial distances between the front and rear intersection rollers and the travelling wheel within the horizontal plane are both longer than the width of the gap along the travelling direction, the front and rear intersection rollers are supported by the rail during passage of the travelling wheel through the gap. This can result in smooth travelling through the gap. Further, when the intersection roller is in contact with the rail in places other than the intersection, the straight stability of the travelling vehicle is enhanced, to prevent curve-travelling. However, the structure of the rail is set such that the intersection roller is in contact with the rail only in the intersection, or the structure of the travelling vehicle is set such that the intersection roller is separated from the rail in the places other than the intersection, and hence in principle, the intersection roller is not in contact with the rail in the places other than the intersection. In the present specification, a description of the travelling vehicle system is applied as it is to the travelling method, and a description of the travelling method is applied as it is to the travelling vehicle system.

It is preferable that an intersection guide for supporting the intersection rollers be provided on the rail from an upstream side through a downstream side of the intersection, and the intersection guide project from the rail so as to reduce the width of the gap. In this manner, the intersection roller is in contact with the rail only in the intersection, and further, the gap can be reduced due to the intersection guide. In order to make the intersection roller retreat, for example, a lifting mechanism for the intersection roller may be provided so that the intersection roller comes into contact with the rail at a lower position and retreats from the rail at an upper position. However, the above intersection guide does not require the lifting mechanism for the intersection roller, and the like.

It is preferable that the travelling vehicle include a pair of front and rear bogie vehicles, and a body supported from the front and rear bogie vehicles by vertical axles, and the travelling wheel is arranged so as to be rotated around one axle for each of the bogie vehicles, the rail include openings, which receive the vertical axles, at a center part in a width direction, the openings cross in the gap, and the travelling vehicle further include a turn preventive mechanism for preventing a turn of the bogie vehicle in the intersection. In the travelling vehicle with the body supported by the pair of front and rear bogie vehicles, the moment of force is transmitted from the body to the bogie vehicle, and in association with the travelling wheel being a single axis, the bogie vehicle may turn, namely a posture of the bogie vehicle may become unstable. In contrast, when the turn preventive mechanism is provided, it is possible to prevent the turn of the bogie vehicle in the intersection.

It is preferable that the turn preventive mechanism be a flange provided on the intersection roller and facing an opening-side end surface of the rail. The flange is made in contact with the end surface of the rail, to prevent the turn of the bogie vehicle. The contact between the flange and the end surface of the rail is made by sliding, not by rolling, thus generation of dust tends to occur. Hence it is preferable that a small gap be provided between the flange and the end surface of the rail, and the turn of the bogie vehicle be prevented by the flange when the bogie vehicle shifts to or beyond this gap.

Further, it is preferable that the turn preventive mechanism be a guide roller guided by the track from the upstream side through the downstream side of the intersection. While proving the guide rollers at the front and rear of the bogie vehicle is known, a guide roller is added to a center part of the bogie vehicle in the travelling direction, or to some other part, for example. When the tracks are made to intersect, there is generated a section in which the guide by the guide roller is interrupted. Then, in this section, the guide is performed by the additional guide roller. When the additional guide roller is continually guided by the track, curve-travelling and the like can be prevented. Therefore, the additional guide roller is guided from the upstream side through the downstream side of the intersection, and it is not guided in the other sections. In order to do this, for example, an extending/retreating mechanism for moving the guide roller is provided, or the shape of the track is set such that the normal guide roller and the additional guide roller are made different in height and the additional guide roller is guided only in and in the vicinity of the intersection. Further, it is preferable that a small gap be present between the additional guide roller and the guiding surface of the track, or the additional guide roller be elastically in contact with the guiding surface, so as to prevent an excess guide. As the turn preventive mechanism, other than the above, the inter-axial distance between the conventional guide rollers may be made longer than the gap in the guiding surface, and one guide roller may continually function in the intersection.

DETAILED DESCRIPTION OF PREFERRED EMBODIMENTS

Hereinafter, an embodiment for carrying out the present invention will be shown. The scope of the present invention is to be set in accordance with the understanding of a skilled person in the art, taking into consideration the description in this specification, the known technique in this field, and the claims.

Embodiment

Figure 1:
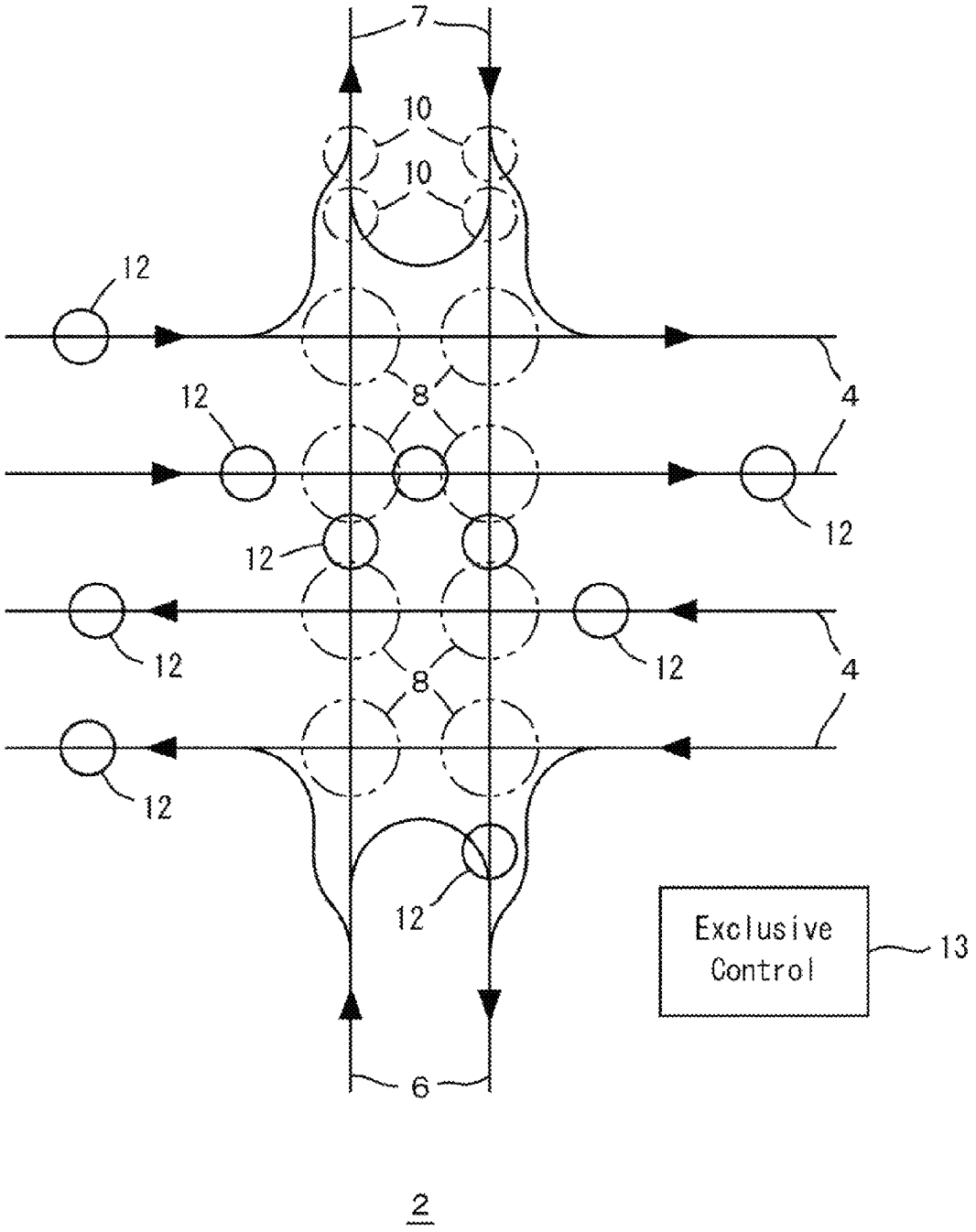
FIG. 1 is a plan view illustrating a layout of an overhead travelling vehicle system of an embodiment.

FIGS. 1 to 10 illustrate an overhead travelling vehicle system 2 of an embodiment, and modification thereof. FIG. 1 illustrates a layout of the overhead travelling vehicle system 2. A track 4 is a track on an inter-bay route, and tracks 6, 7 are tracks on an intra-bay route. A plurality of overhead travelling vehicles 12 travel along tracks 4, 6, 7, and the tracks 4, 6, 7 have the same structure, for example. In FIG. 1, four parallel tracks 4 are arranged on the inter-bay route, but the number of tracks 4, 6, 7 is arbitrarily. The track 4 and the tracks 6, 7 may intersect at right angles at an intersection 8 in a horizontal plane, and may intersect not only at right angles but also diagonally. Providing the intersection 8 enables the tracks to intersect, and the intersection 8 means an area provided with special equipment for the tracks to intersect.

Numeral 10 denotes a branching/merging part, being a portion where the track of the overhead travelling vehicle 12 is branched or merged. Providing the intersection 8 enables reduction in time for movement between the tracks 6, 7 on the intra-bay route. When the tracks 6, 7 on the intra-bay route are connected by a large number of branching/merging parts as have hitherto been done, travelling across the inter-bay route takes a long period of time. Further, an installation place of the intersection 8 is arbitrary. The intersection 8 is provided not only in a place where the inter-bay route and the intra-bay route intersect, but also in a place where the tracks are to intersect. A rejection controlling (exclusive control) part 13 performs rejection control so as to prevent two overhead travelling vehicles 12, 12 from simultaneously getting into one intersection 8, and a rejection controlling mechanism is arbitrarily.

Figure 2:
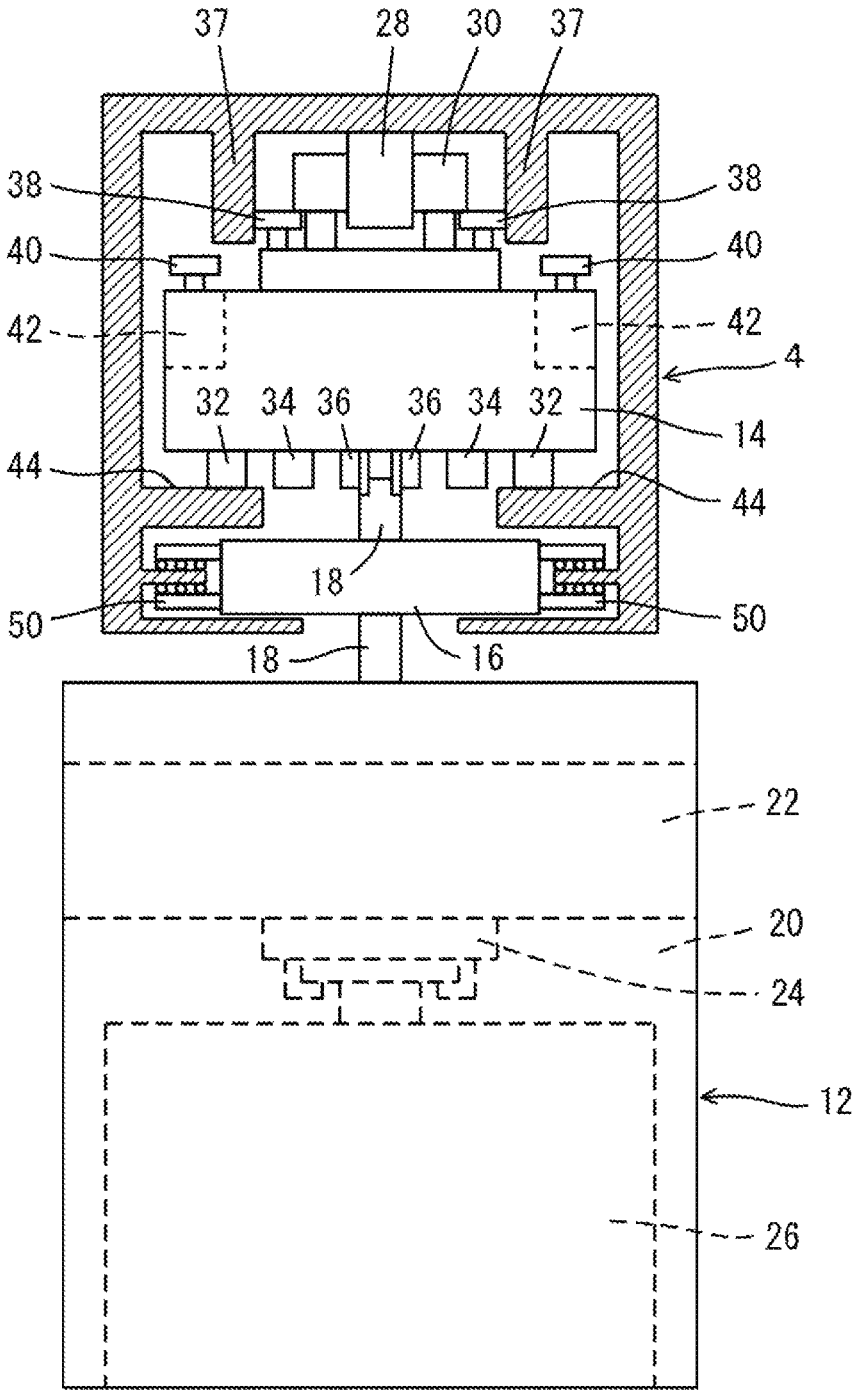
FIG. 2 is a sectional view of a main part of an overhead travelling vehicle and a track in the embodiment.
Figure 3:
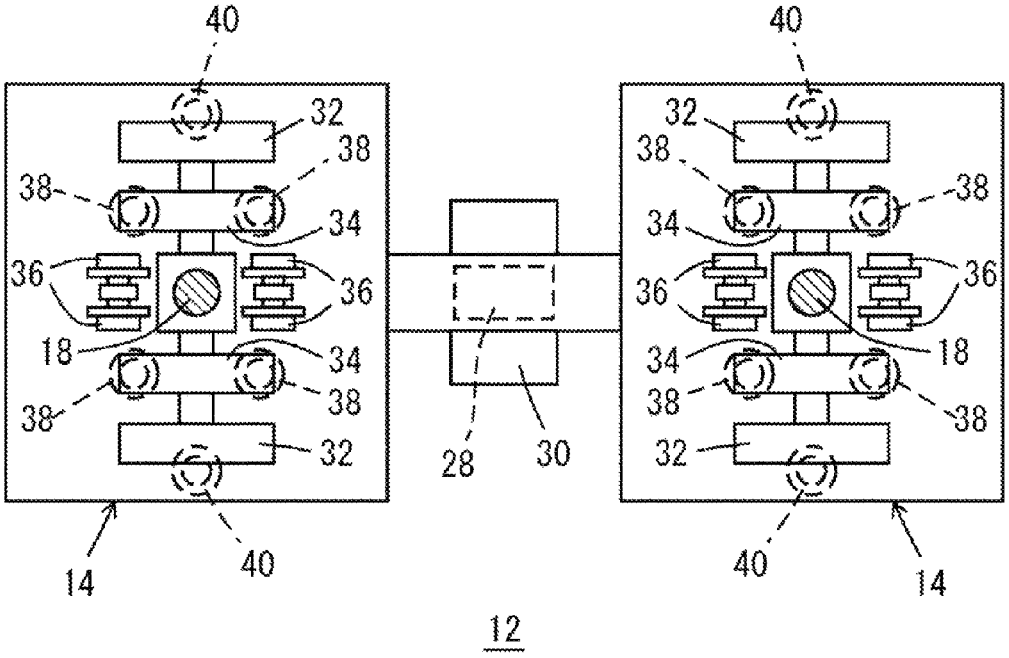
FIG. 3 is a bottom view of the overhead travelling vehicle in the embodiment.

FIGS. 2 and 3 illustrate a structure of the overhead travelling vehicle 12, in which a pair of front and rear bogie vehicles 14, 14 are provided, and power feeding vehicles 16, 16 are provided below the bogie vehicles 14, 14. A body 20 of the overhead travelling vehicle 12 is supported by the pair of front and rear bogie axles 18, 18, and the overhead travelling vehicle 12 is a suspension-type travelling vehicle. Further, a driving wheel 28 and a travelling motor 30 are arranged so as to bridge between the pair of front and rear bogie vehicles 14, 14. It is to be noted that the body 20 lifts and lowers a lift stage 24 by a hoist 22, and the overhead travelling vehicle 12 holds an article such as a FOUP 26 by the lift stage 24, and carries the article.

Figure 4:
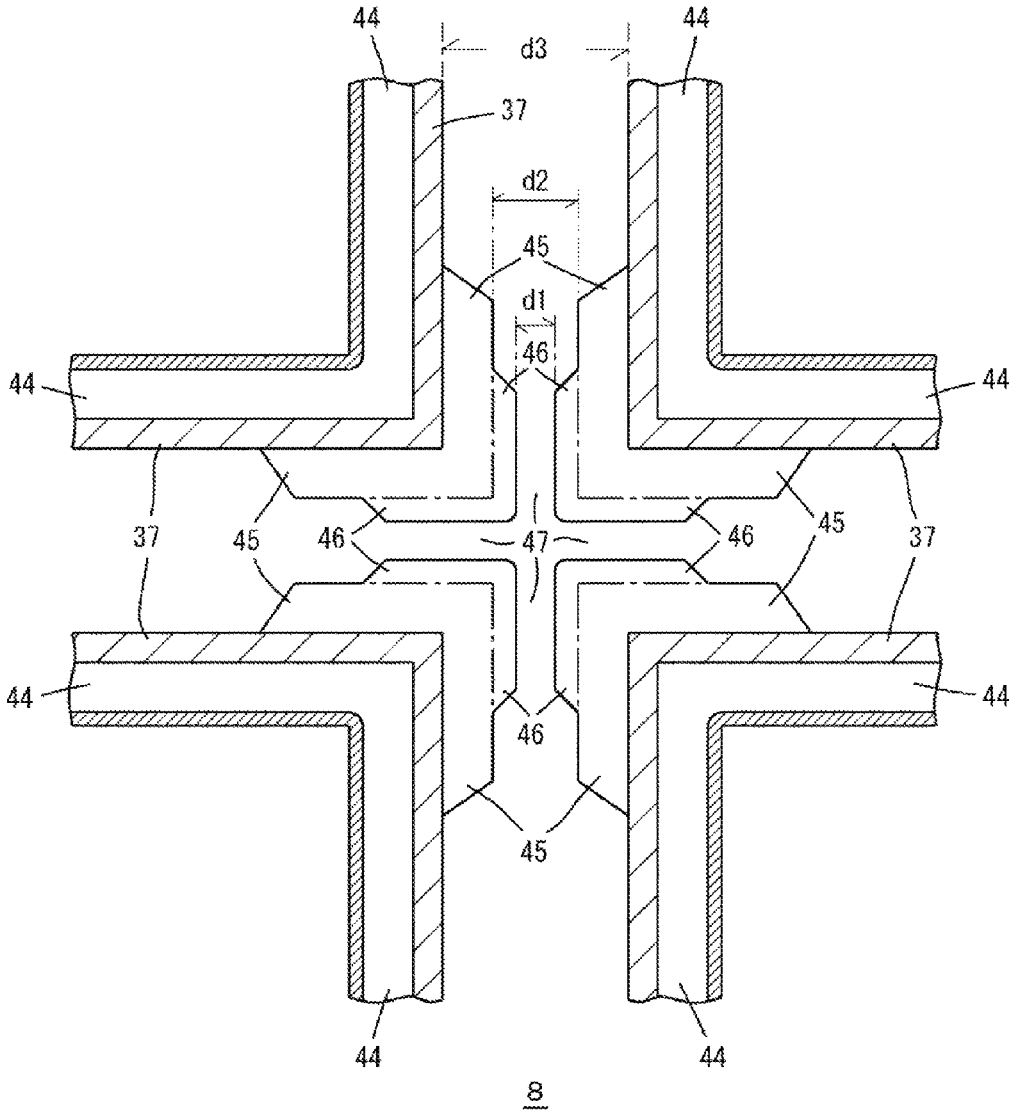
FIG. 4 is a horizontal-plane sectional view of the tracks in an intersection in the embodiment.

The bogie vehicle 14 includes outer driven wheels 32, 32 and inner driven wheels 34, 34, and four driven wheels 32, 32, 34, 34 are arranged along one axle. As for the inside and outside, the center side of the track within the horizontal plane is shown as the inside and the opposite side thereto is shown as the outside. For example, basically, the outer driven wheels 32, 32 continually support the bogie vehicle 14, and the inner driven wheels 34, 34 support the bogie vehicle 14 only in a curve section, the branching/merging part and the intersection 8, and the like. At least each pair of the front and rear intersection rollers 36, 36 is provided on the inner side of the inner driven wheels 34, 34, and the intersection rollers 36, 36 support the bogie vehicle 14 only in the intersection, for example. The inter-axial distance between the driven wheel 34 and the intersection roller 36 within the horizontal plane is longer than a gap d1 in the opening 47 in the intersection 8, which is illustrated in FIG. 4, and an inter-axial distance between the front and rear intersection rollers 36, 36 is longer than 2d1. The overhead travelling vehicle 12 is characterized by the intersection roller 36 and arrangement thereof.

A pair of front and rear guide rollers 38 is provided in an upper part of the bogie vehicle 14 and is guided by an overhead guide 37, to stabilize a posture of the bogie vehicle 14. In the upper portion of the bogie vehicle 14, for example, a pair of right and left branching/merging rollers 40 is further provided, and is lifted and lowered by a lifting mechanism 44. When the branching/merging roller 40 is lifted, the branching/merging roller 40 is guided by the overhead guide 37, and when the branching/merging roller 40 is lowered, the branching/merging roller 40 comes out of contact with the overhead guide 37. Lifting and lowering the branching/merging roller 40 controls the track of the overhead travelling vehicle 12 to branch off and merge. It is to be noted that in the present specification, right and left are directions orthogonal to a longitudinal direction of the track within the horizontal plane.

A main rail 44 is located below the track 4 and the like, and supports the driven wheel 32. Further, the power feeding vehicle 16 includes a power receiving coil 50 and the like, and receives power from a litz wire or the like provided on the track 4 or the like in a contactless manner. It is to be noted that the power feeding vehicle 16 includes a capacitor or a secondary battery such as a lithium-ion battery, and can continue operation even when power supply is temporarily stopped. In the embodiment, the overhead travelling vehicle 12 has been shown as the travelling vehicle, but it only has to be a suspension-type travelling vehicle, and especially when a plurality of bogie vehicles are provided in the travelling vehicle, the embodiment applies to that case. Although the bogie vehicle 14 does not include a driving wheel in the overhead travelling vehicle 12, a travelling motor may be provided in each bogie vehicle 14, and the driven wheels 32, 34 may be replaced by driving wheels.

Figure 5:
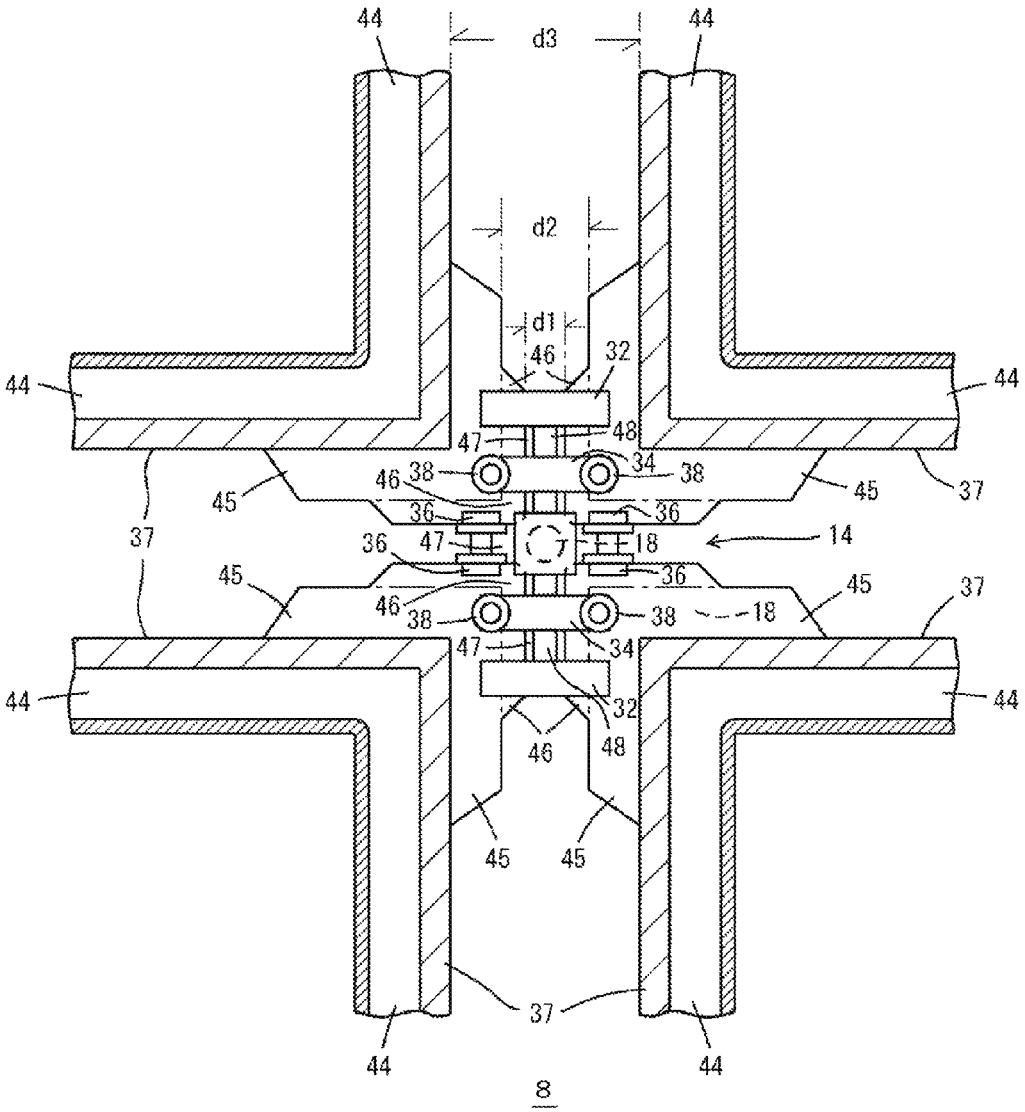
FIG. 5 is a horizontal-plane sectional view illustrating the relation among the tracks, driven wheels, intersection rollers, and guide rollers in the intersection in the embodiment.

FIGS. 4 and 5 illustrate a structure of the track in the intersection 8. In FIGS. 4 and 5, the track has been cut off horizontally at a height of the overhead guide 37 in the upper portion of the track and illustrated as seen from above. FIG. 4 illustrates only the structure of the intersection 8, and FIG. 5 illustrates the relation with the wheels and the like of the bogie vehicle 14. Further, in the intersection 8, the branching/merging roller 40 has been lowered, and does not come into contact with the overhead guide 37.

At the intersection 8, a branching/merging rail 45 projects from a main rail 44 to reduce the gap, and an intersection guide 46 further projects from the branching/merging rail 45 to further reduce the gap. A gap between the intersection guides 46, 46 is referred to as d1, a gap between the branching/merging rails 45, 45 is referred to as d2, and a gap between the main rails 44, 44 is referred to as d3. The relation of those gaps is "d1<d2<d3", and a gap between the overhead guides 37, 37 is the same as d3, for example. It should be noted that the branching/merging rail 45 allows the bogie vehicle 14 to smoothly travel through the gap in the branching/merging part. The intersection guide 46 serves to reduce the gap in the intersection 8 and allow the bogie vehicle 14 to smoothly travel, and is one of characteristics of the embodiment. As described above, the inter-axial distance between the intersection roller 36 and the driven wheels 34 on the horizontal plane is made larger than d1, and the inter-axial distance between the guide rollers 38, 38 is made shorter than d3 and longer than d2, for example, thereby reducing a body length of the bogie vehicle 14.

When the driven wheel 34 and the intersection roller 36 are brought into contact with the track, the stability in a straight direction increases but curve-travelling becomes difficult, and hence the branching/merging rail 45 and the intersection guide 46 are provided only around the gap in the intersection 8. Herein, the intersection guide 46 is provided over a section narrower than the branching/merging rail 45, but these may be provided so as to have the same length.

Figure 6:
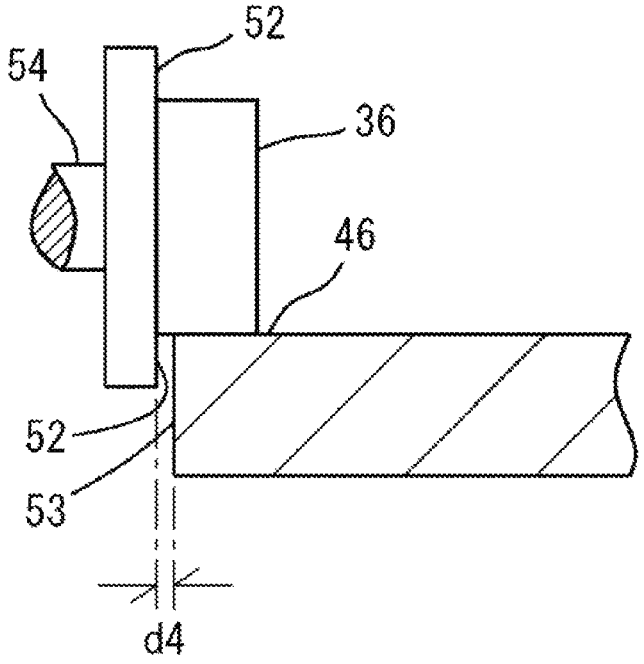
FIG. 6 is a horizontal sectional view of a main part, illustrating a gap between a rail and the intersection roller in the embodiment.

As illustrated in FIG. 6, a flange 52 is preferably provided at the end of the intersection roller 36 on the inner side of the track, and made to face an end surface 53 of the intersection guide 46 on the inner side of the track. A gap between the flange 52 and the end surface 53 is referred to as d4, and when a lateral position of the bogie vehicle 14 shifts to or beyond gap d4 in the intersection, the flange 52 is guided by the end surface 53. Similarly to the conventional intersection roller, it is preferable that a body of the intersection roller 36 be made of an elastic body such as urethane rubber, and the flange 52 be made of a hard resin such as a POM (polyacetal) resin, to reduce generation of dust. Numeral 54 denotes an axle of the intersection roller 36.

Figure 7:
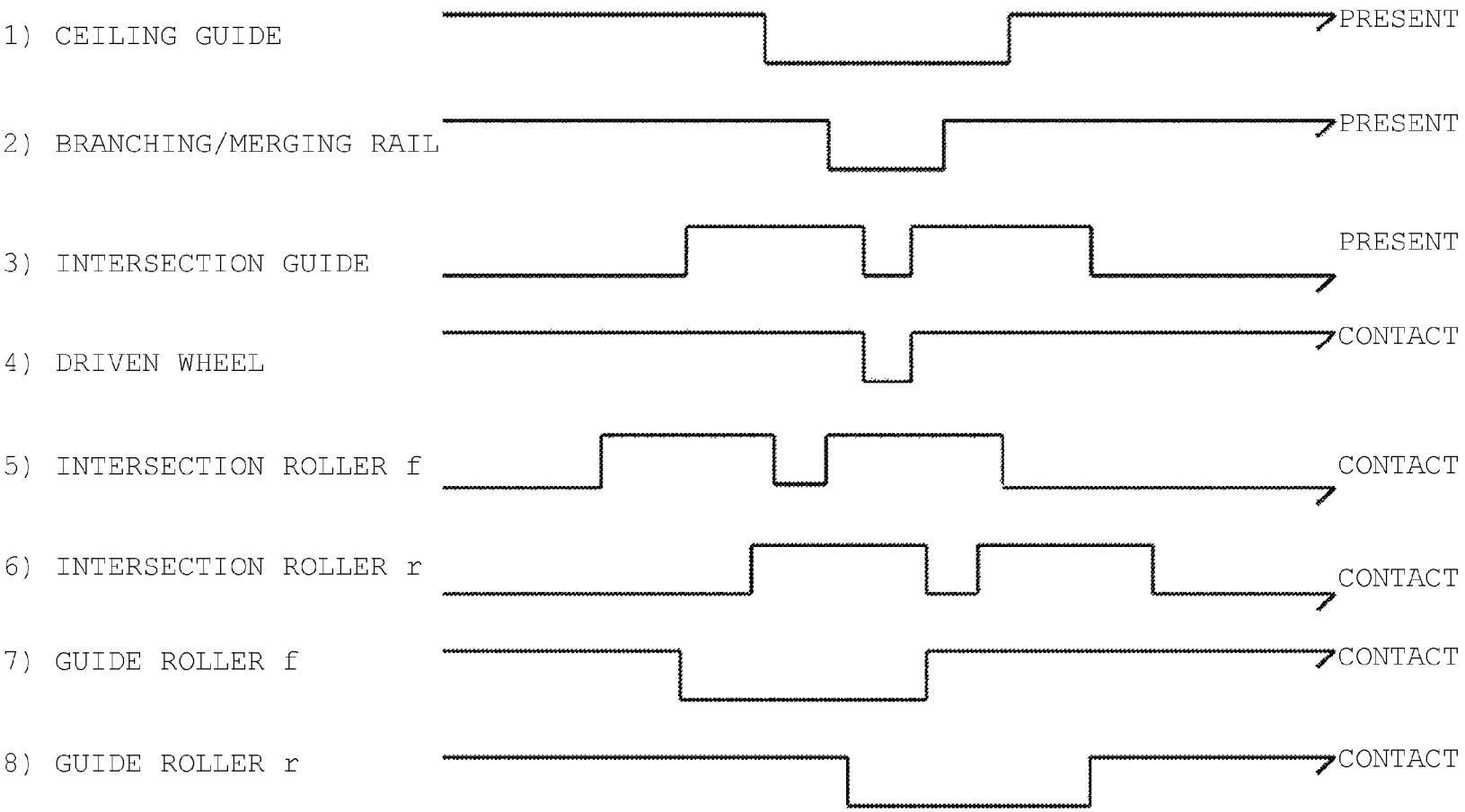
FIG. 7 is a waveform diagram illustrating the presence or absence of the rail and operation of each roller in and in the vicinity of the intersection in the embodiment.

FIG. 7 illustrates the support and guide of the bogie vehicle in the intersection. During passage of the driven wheel 34 through the gap d1, the bogie vehicle 14 is supported by the intersection rollers 36, 36, and the posture of the bogie vehicle is prevented from becoming unstable due to the gap d3 in the overhead guide. In FIG. 7, 1) illustrates the gap in the overhead guide, 2) illustrates the gap in the branching/merging rail, and 3) illustrates the gap in the intersection guide. Symbol f denotes the front side and symbol r denotes the rear side. Since the inter-axial distances between the front and rear intersection rollers 36, 36 and the driven wheel 34 on the horizontal plane are longer than the gap d1, the front and rear intersection rollers 36, are both supported by the intersection guide 46 during passage of the driven wheel 34 through the gap d1. Hence the gravity applied on the bogie vehicle 14 is continually stably supported.

Since the inter-axial distance between the guide rollers 38, 38 is shorter than the gap d3, there is a time period during which none of the front and rear guide rollers 38, 38 is guided by the overhead guide 37. Then, the flange 52 is provided on the intersection roller 36, to stabilize the posture of the bogie vehicle 14. However, since the gap d1 is short and the driven wheel 34 having high straight stability is supported by the track, the posture of the bogie vehicle 14 is hardly deformed even without the flange 52. Accordingly, even without the flange 52, the posture of the bogie vehicle is practically sufficiently stable. As described above, the overhead travelling vehicle 12 can smoothly travel through the intersection 8. In addition, since the intersection roller 36 is located on the inside of the branching/merging rail 45, it is not in contact with the track in the branching/merging part 10 and the curve section.

Figure 8:
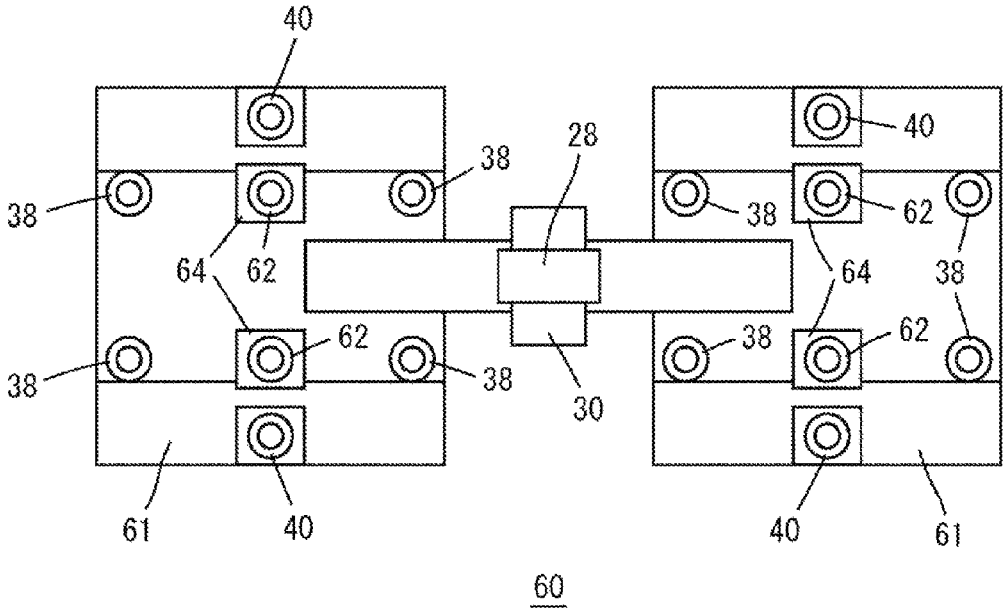
FIG. 8 is a plan view of an overhead travelling vehicle in an alternative embodiment.
Figure 9:
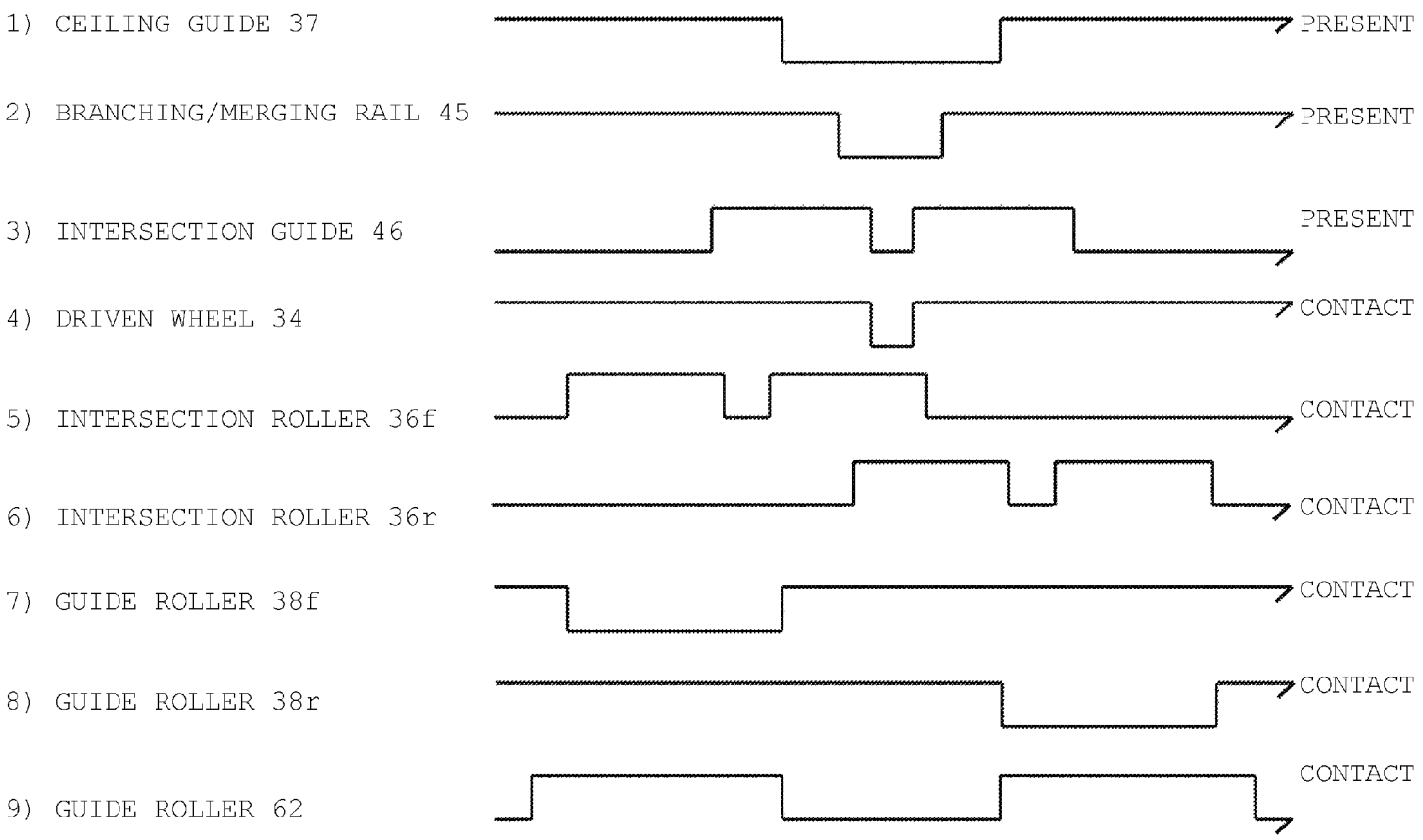
FIG. 9 is a waveform diagram illustrating the presence or absence of the rail and operation of each roller in and in the vicinity of the intersection in the alternative embodiment.

FIGS. 8 and 9 illustrate an overhead travelling vehicle 60 of an alternative embodiment. This is similar to that in the embodiment of FIGS. 1 to 7 except for the respects that will be particularly pointed out, and especially the structure of the intersection 8 is the same. A bogie vehicle 61 is formed by providing in the bogie vehicle 14 the pairs of right and left guide rollers 62, 62 and lifting mechanisms 64, 64 which are lifatble. The guide roller 62 is, for example, provided in an upper part of the driven wheel 34, namely on the right and left of the bogie vehicle 14 in the vicinity of the center of a bilateral direction of the bogie vehicle 14. Further, the guide roller 62 may not extend or retreat vertically, but may extend or retreat laterally. The guide roller 62 is in contact with the overhead guide 37 only in the intersection 8, and an inter-axial distance between the guide roller 62 and each of the front and rear guide rollers 38, 38 is made longer than the gap d3. At least two guide rollers 38, 62 are continually guided by the overhead guide 37 along a longitudinal direction in the intersection 8. Further, the guide roller 62 is in contact with the overhead guide 37 only in the intersection 8. It is to be noted that the flange 52 of the intersection roller 36 may not be present, and in order to prevent unnecessary force from functioning by the guide roller 62, a slight gap is preferably provided between the overhead guide 37 and the guide roller 62 at a lifted position.

FIG. 9 illustrates the guide and support of the bogie vehicle 61. As illustrated in 9), a guide by the guide roller 62 is added, and hence the bogie vehicle 61 is continually guided by the guide rollers both on its front and rear, leading to further improvement in stability of the posture.

Figure 10:
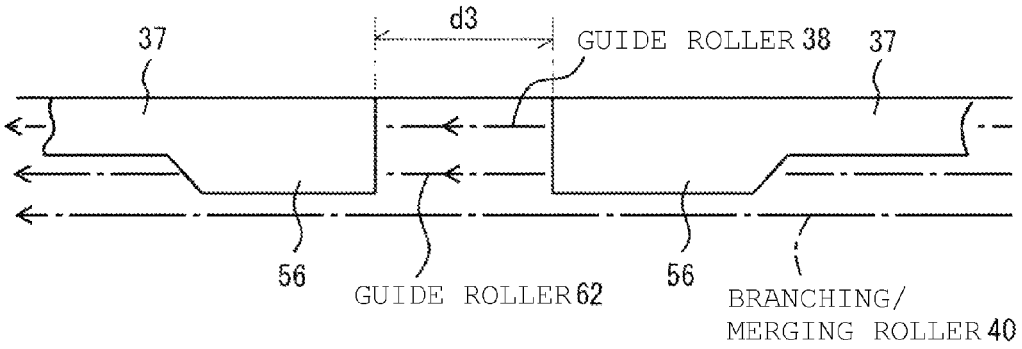
FIG. 10 is a view illustrating traces of the guide rollers with respect to an overhead guide in a second alternative embodiment.

FIG. 10 illustrates a second alternative embodiment. A height of the guide roller 62 is set to the middle between the guide roller 38 and the branching/merging roller 40. In the intersection 8, hanging parts 56, 56 are hung downward from the overhead guide 37 on both sides of the gap d3, to guide the guide roller 62, but the overhead guide 37 is out of contact with the branching/merging roller 40. Also in this manner, similarly to the alternative embodiment of FIGS. 8 and 9, it is possible to prevent the guide by the pair of front and rear guide rollers from being interrupted by the gap d3. In the alternative embodiment of FIG. 10, the guide roller 62 is in contact with the overhead guide 37 only in the intersection 8 and the branching/merging part 10.

The embodiment has the following characteristics.

1) The intersection rollers 36, 36, with an inter-axial distance to the driven wheel 34 being longer than the gap d1, are provided both in front and rear of the driven wheel 34, thereby enabling support of the bogie vehicle 14 by the front and rear intersection rollers 36, 36 during passage of the driven wheel 34 through the gap d1.

2) By providing the intersection guide 46 in the intersection 8 in addition to the branching/merging rail 45, the gap d1 can be made narrower.

3) Since the inter-axial distance between the guide rollers 38, 38 is made shorter than the gap d3, the body length of the bogie vehicle 14 can be reduced.

4) Providing the flange 52 on the intersection roller 36 enables regulation of the posture of the bogie vehicle 14.

5) The intersection roller 36 is in contact with the track only in the intersection 8, and does not have an influence on travelling in the other sections.

The alternative embodiments further have the following characteristics.

6) Since the inter-axial distance between the guide rollers 38, 38 is longer than the gap d3, the bogie vehicle 61 is continually guided by either of the guide rollers 38, 38 in the intersection 8.

7) Further, when the guide roller 62 is provided and the inter-axial distance between the guide rollers 38, 62 is made longer than the gap d3, the pair of front and rear guide rollers 38, 62, 38 are continually guided by the overhead guide 37 in the intersection 8.

It is to be noted that a mechanism for lifting and lowering the intersection roller 36 may be provided so that the intersection roller 36 retreats upward in places other than the intersection 8.

What is claimed is:

1. A travelling vehicle system for allowing a suspension-type travelling vehicle to travel along a rail provided on a track, the system comprising:

an intersection in which tracks cross each other, the intersection having a gap in which a rail for supporting a weight of the travelling vehicle is interrupted, wherein the travelling vehicle includes a travelling wheel that makes the rail support the weight of the travelling vehicle, and intersection rollers that are attached both in front and rear of the travelling wheel along a travelling direction in positions different from a position of the travelling wheel along a direction orthogonal to the travelling direction within a horizontal plane, inter-axial distances between the intersection rollers and the travelling wheel within the horizontal plane are both longer than a width of the gap along the travelling direction, and the rail or the travelling vehicle is configured such that the intersection rollers are supported by the rail in the intersection, and are separated from the rail in places other than the intersection.

2. The travelling vehicle system according to claim 1, wherein an intersection guide for supporting the intersection rollers is provided on the rail from an upstream side through a downstream side, and the intersection guide projects from the rail so as to reduce the width of the gap.

3. The travelling vehicle system according to claim 1, wherein the travelling vehicle includes a pair of front and rear bogie vehicles, and a body supported from the front and rear bogie vehicles by vertical axles, and the travelling wheel is arranged so as to be rotated around an axle for each of the bogie vehicles, the rail includes openings, which receive the vertical axles, at a center part in a width direction, the openings cross in the gap, and the travelling vehicle further includes a turn preventive mechanism for preventing a turn of the bogie vehicle in the intersection.

4. The travelling vehicle system according to claim 3, wherein the turn preventive mechanism is a flange provided on the intersection roller and facing an opening-side end surface of the rail.

5. The travelling vehicle system according to claim 3, wherein the turn preventive mechanism is a guide roller guided by the track from the upstream side through the downstream side of the intersection.

6. A travelling method for allowing a suspension-type travelling vehicle to travel through a gap in an intersection where tracks cross, wherein the travelling vehicle includes a travelling wheel that makes a rail support a weight of the travelling vehicle, and intersection rollers that are attached both in front and rear of the travelling wheel along a travelling direction in positions different from a position of the travelling wheel along a direction orthogonal to the travelling direction within a horizontal plane, inter-axial distances between the intersection rollers and the travelling wheel within the horizontal plane are both longer than a width of the gap along the travelling direction, the rail or the travelling vehicle is configured such that the intersection rollers are supported by the rail in the intersection, and are separated from the rail in places other than the intersection, and during passage of the travelling wheel through the gap, the weight of the travelling vehicle is supported by the front and rear intersection rollers by making both the front and rear intersection rollers in contact with the rail.

* * * * *